US011779781B2

(12) United States Patent
Anvari

(10) Patent No.: US 11,779,781 B2
(45) Date of Patent: Oct. 10, 2023

(54) FACE MASK WITH A NECK HANGER

(71) Applicant: Kiomars Anvari, Walnut Creek, CA (US)

(72) Inventor: Kiomars Anvari, Walnut Creek, CA (US)

(73) Assignee: Kiomars Anvari, Walnut Creek, CA (US)

( * ) Notice: Subject to any disclaimer, the term of this patent is extended or adjusted under 35 U.S.C. 154(b) by 0 days.

(21) Appl. No.: 17/891,205

(22) Filed: Aug. 19, 2022

(65) Prior Publication Data

US 2023/0129698 A1 Apr. 27, 2023

Related U.S. Application Data

(63) Continuation-in-part of application No. 63/272,659, filed on Oct. 27, 2021.

(51) Int. Cl.

| | |
|---|---|
| ***A62B 7/00*** | (2006.01) |
| ***A62B 7/10*** | (2006.01) |
| ***A62B 18/02*** | (2006.01) |

(52) U.S. Cl.

CPC ..... *A62B 7/10* (2013.01); *A62B 18/025* (2013.01)

(58) Field of Classification Search

CPC ..... A62B 7/10; A62B 18/003; A62B 18/006; A62B 18/02; A62B 18/025; A62B 18/04; A62B 18/045; A62B 18/08; A62B 18/084; A62B 23/00; A62B 23/02; A41D 13/1153; A61M 16/105

See application file for complete search history.

(56) References Cited

U.S. PATENT DOCUMENTS

| | | | | |
|---|---|---|---|---|
| 2,318,790 | A * | 5/1943 | Martindale | A41D 13/11 128/206.16 |
| 2,758,307 | A * | 8/1956 | Treiber | A41D 13/1184 2/9 |
| 3,921,223 | A * | 11/1975 | Hoyecki | A61F 9/068 2/9 |
| H1361 | H * | 10/1994 | Tardiff, Jr. | 2/205 |
| 6,443,153 | B1 * | 9/2002 | Viljanen | A61F 9/068 128/206.28 |
| 7,481,221 | B2 * | 1/2009 | Kullik | A61M 16/0009 128/204.11 |
| 7,828,524 | B2 * | 11/2010 | Chen | F04D 25/084 415/206 |
| 9,248,248 | B2 * | 2/2016 | Virr | A61M 16/0066 |
| 9,622,546 | B2 * | 4/2017 | Turdjian | A44B 11/06 |
| 10,537,754 | B1 * | 1/2020 | Vukelja | A62B 18/003 |
| 10,874,151 | B1 * | 12/2020 | Clark | A41D 13/0025 |
| 11,122,843 | B2 * | 9/2021 | Emery | A41D 13/1161 |

(Continued)

*Primary Examiner* — LaToya M Louis

(57) ABSTRACT

A face mask uses a neck hanger to facilitate the flow of filtered fresh air inside the face mask for inhaling. The neck hanger is a lightweight tube that has a U shape and hangs from the neck of a user. The neck hanger houses a fan with a filter at either side, and a battery with a controller circuit. Two flexible pipes connect the face mask to the neck hanger from either side. The neck hanger sucks the air from the environment using a fan and filters it before being blown into the face mask through a flexible pipe. The face mask's contaminated interior air through another flexible pipe is sucked be another fan and filtered by a filter before being released into the environment.

9 Claims, 13 Drawing Sheets

Neck Hanger 1100

(56) References Cited

U.S. PATENT DOCUMENTS 11,471,711 B2 * 10/2022 Connor ..... A62B 18/08
2005/0028250 A1 * 2/2005 Zaic ..... A42B 3/16 2/209
2005/0229557 A1 * 10/2005 Little ..... A47C 7/383 55/385.1
2008/0237287 A1 * 10/2008 Mitchinson ..... A45F 3/04 224/645
2009/0127304 A1 * 5/2009 Uygur ..... A45F 5/02 224/250
2010/0319688 A1 * 12/2010 Amarasinghe .... A61M 16/0816 128/201.22
2011/0079225 A1 * 4/2011 Vole ..... A61M 15/08 128/206.24
2013/0227768 A1 * 9/2013 Van Waes ..... A42B 3/185 2/10
2014/0196187 A1 * 7/2014 Beliveau ..... A41D 13/11 2/9
2014/0261428 A1 * 9/2014 Chen ..... A62B 23/02 128/205.12
2015/0290479 A1 * 10/2015 Augustine ..... A62B 23/02 128/200.28
2016/0058134 A1 * 3/2016 Blunt ..... A44C 5/0023 454/329
2017/0080262 A1 * 3/2017 Freres ..... H04R 1/028
2017/0274246 A1 * 9/2017 Danford ..... A63B 23/18
2017/0361134 A1 * 12/2017 Virr ..... A62B 18/082
2018/0001120 A1 * 1/2018 Virr ..... A62B 18/025
2018/0078798 A1 * 3/2018 Fabian ..... A61B 5/0816
2018/0318540 A1 * 11/2018 Barlow ..... A61M 16/0611
2020/0114178 A1 * 4/2020 Waterford ..... A62B 23/02
2020/0289777 A1 * 9/2020 Bearne ..... A61M 16/06
2020/0397087 A1 * 12/2020 Crenshaw ..... A41D 1/002
2020/0406069 A1 * 12/2020 Fu ..... A62B 23/02
2021/0077762 A1 * 3/2021 Mauger ..... A61M 16/107
2021/0093903 A1 * 4/2021 Edwards ..... A62B 18/006
2021/0339058 A1 * 11/2021 Connor ..... A62B 18/08
2021/0345694 A1 * 11/2021 Volk ..... A41D 13/1161
2021/0345702 A1 * 11/2021 Volk ..... A41D 13/11
2021/0379312 A1 * 12/2021 Bernard ..... A61M 16/209
2021/0386291 A1 * 12/2021 Oddo ..... A61B 5/4806
2022/0008760 A1 * 1/2022 Chen ..... A62B 18/088
2022/0015469 A1 * 1/2022 Markarian ..... A41D 13/1161
2022/0023790 A1 * 1/2022 Lee ..... A62B 18/003
2022/0118288 A1 * 4/2022 Space ..... B01D 46/0047
2022/0143344 A1 * 5/2022 Mauger ..... A62B 7/10
2022/0161065 A1 * 5/2022 Tindall ..... A62B 7/10
2022/0266068 A1 * 8/2022 Connor ..... A62B 7/10
2022/0305301 A1 * 9/2022 Yoon ..... A62B 18/003
2022/0387829 A1 * 12/2022 Matti ..... A62B 18/025
2023/0011058 A1 * 1/2023 Squires ..... A41D 23/00

* cited by examiner

Neck Hanger 1000

Neck Hanger 1100

Neck Hanger 1100

Neck Hanger 1200

Neck Hanger 1200

FACE MASK WITH A NECK HANGER

The application claims priority to the following related applications and included here are as a reference.

Application: U.S. patent application No. 63/272,659 filed Oct. 27, 2021.

BACKGROUND

Controlling air pollution in the environment has become increasingly important owing to the health risks of exposure to high concentrations of harmful air pollutants. PM2. 5 or particles that make the air polluted and have diameter less than 2.5 micrometres (more than 100 times thinner than a human hair) remain suspended in the air for longer time. These particles are formed because of burning fuel, chemical reactions that take place in the air, and other sources of aerosol droplets. To protect people against the harmful effects of air pollution, filtering of these pollutants is significant. Thus, understanding the filtration performance of solutions is essential for assessing the air quality.

Masks have been on the market for many years and are especially suitable in the "urban environment", i.e., when walking, biking, and commuting in the city and having to get through heavy traffic where cars are the source of pollution (especially those diesel cars). The masks have always been mentioned as an effective tool against environmental threats. They are considered as protective equipment to preserve the respiratory system against the non-desirable air droplets and aerosols such as the viral or pollution particles.

The aerosols can be pollution existence in the air, or the infectious airborne viruses initiated from the sneezing, coughing of the infected people. The filtration efficiency of the different masks against these aerosols are not the same, as the particles have different sizes, shapes, and properties. Therefore, the challenge is to fabricate the filtration masks with higher efficiency to decrease the penetration percentage at the nastiest conditions. To achieve this concept, knowledge about the mechanisms of the penetration of the aerosols through the masks at different effective environmental conditions is necessary.

This application discloses a novel face mask with a neck hanger that facilitates flow of filtered fresh air inside the face mask for inhaling. The neck hanger is a lightweight tube that houses two fans, HEPA or ULPA filters, and a battery with a controller circuit. One fan sucks the air from the environment and after being filtered is blown into the face mask through an air pipe that is attached to both the neck hanger and the face mask. The exhaled air from the nose or mouth is sucked by a second fan through another air pipe, then filtered and released into the environment.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In one aspect, a face mask that is used for protection against aerosols in the environment has a neck hanger or a head ring.

In another aspect, the neck hanger or head ring are connected to the face mask via two flexible air pipes.

In another aspect, both head ring and neck hanger are tubes with circular or rectangular cross sections.

In one aspect, both neck hanger and head ring use two fans, one for sucking the air from the environment and one for sucking the interior air of the face mask.

In another aspect, both neck hanger and head ring use two filers, one for filtering sucked air from the environment and one for filtering sucked air from interior of the face mask.

In one aspect, the filtered air from the environment is released into the interior of the face mask and the filtered air from interior of the face mask is released into the environment.

In another aspect, the filtered air from interior of the face mask through some opening holes on the peripheral of neck hanger or head ring is blown towards head and face of the person wearing the face mask for cooling.

In one aspect, the filtered air from the environment is divided into two portions, one is released into the interior of the face mask through an air pipe connected to the face mask and neck hanger or head ring and one portion is blown towards the face and the neck (head) of the person wearing the face mask through some opening holes on the peripheral of head ring or neck hanger.

In one aspect, the area of opening holes across the peripheral of neck hanger and head ring are different to provide a uniform air flow towards the face, neck, and head.

In another aspect, there is a container for oxygen inside the neck hanger or head ring.

In one aspect, the oxygen container is a tube within the neck hanger and head ring.

In another aspect, the neck hanger or head ring has valve to refill the oxygen tank.

In one aspect, the neck hanger or head ring has a regulator that controls the pressure of oxygen tank to a working pressure followed with an oxygen flow adjuster to control and measure the flow of oxygen to the face mask.

In another aspect, the filtered air sucked by sucking fan from the environment is mixed with oxygen before being released to the face mask through an air pipe.

In one aspect, the neck hanger or head ring has a housing for a control circuit and a power supply.

In another aspect, the control circuit controls the speed of the fans and various sensors used by the neck hanger or head ring.

In one aspect, sensors are located at various locations of the neck hanger head ring or face mask to control various functions.

In one aspect, the power supply uses a rechargeable battery.

In another aspect, the rechargeable battery is charged by solar power using micro-panels (small panels) attached to external surface of the face mask and external surface of the head hanger or head ring.

In one aspect, the power supply has a DC (Direct Current) converter circuit to convert solar energy to the DC voltage required for charging the battery.

In one aspect, the rechargeable battery is charged through a USB (universal serial bus) or other power ports.

In another aspect, a charger with a USB or other power cords is used to connect to neck hanger or head ring for charging the battery.

In one aspect, the control circuit and battery can be removed and replaced.

In another aspect, neck hanger or head ring has a physical activation key or nob attached to the exterior surface of the neck hanger or head ring.

In one aspect, the neck hanger or the head ring has a reset bottom or can be reset through USB port or a wireless transceiver.

In one aspect, the USB port is used to communicated with an external device for configuration, download software, and diagnostic.

In another aspect, the control circuit has a transceiver to communicated wirelessly with an external device for configuration, software downloads and diagnostic.

In one aspect, the transceiver used by control circuit is a Bluetooth, Zigbee, infrared, or WiFi.

In another aspect, the environment air is passed through a filter before being sucked by a sucking fan.

In one aspect, both air pipes that are connected to the neck hanger and the face mask also perform filtering of the air sucked from environment and the contaminated air sucked from interior of the face mask.

The drawings referred to in this description should be understood as not being drawn to scale except if specifically noted.

DESCRIPTION OF EMBODIMENTS

Reference will now be made in detail to embodiments of the present technology, examples of which are illustrated in the accompanying drawings. While the technology will be described in conjunction with various embodiment(s), it will be understood that they are not intended to limit the present technology to these embodiments. On the contrary, the present technology is intended to cover alternatives, modifications, and equivalents, which may be included within the spirit and scope of the various embodiments as defined by the appended claims.

Furthermore, in the following description of embodiments, numerous specific details are set forth in order to provide a thorough understanding of the present technology. However, the present technology may be practiced without these specific details. In other instances, well known methods, procedures, components, and circuits have not been described in detail as not to unnecessarily obscure aspects of the present embodiments.

Figure 1:
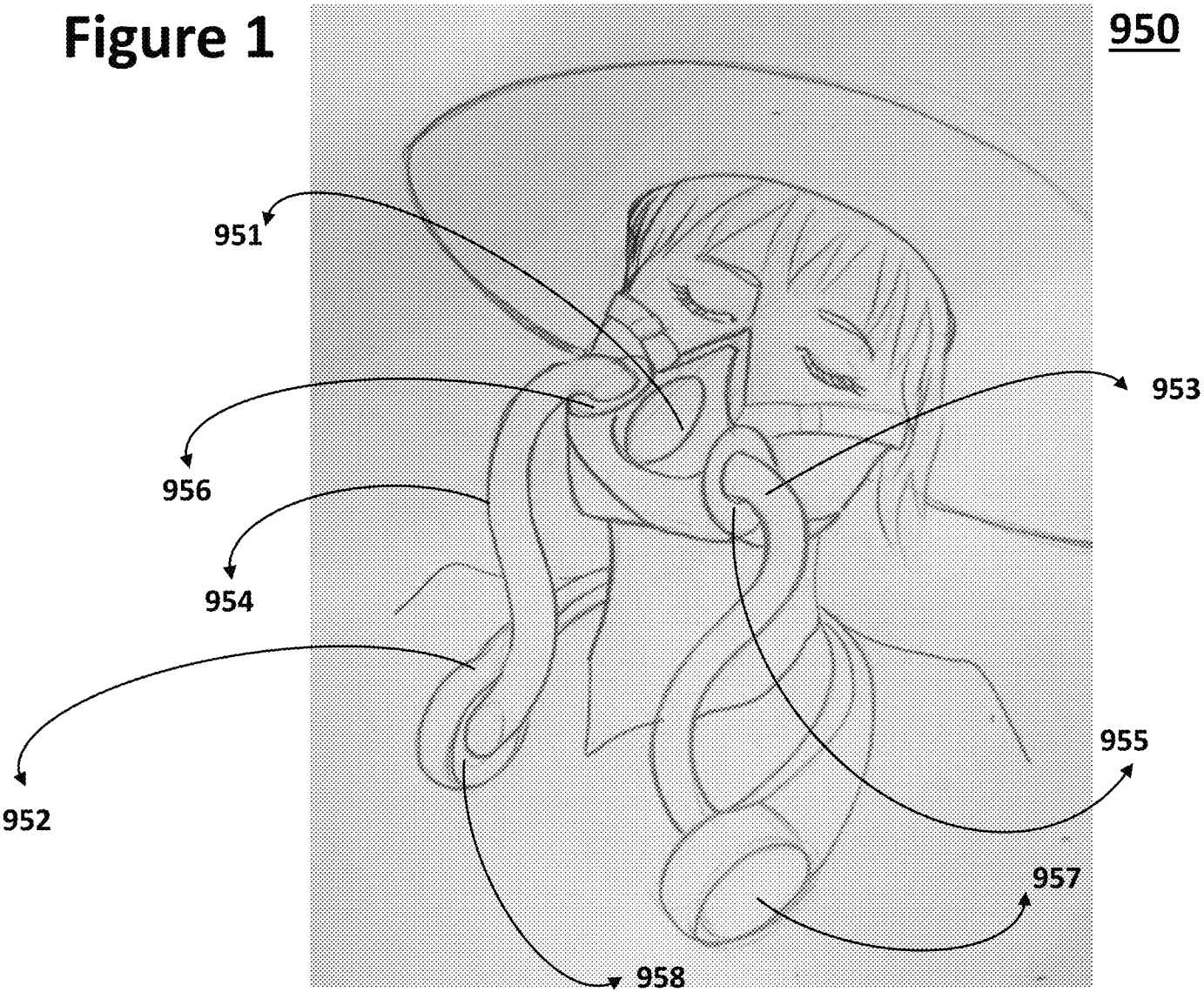
FIG. 1 illustrates a face mask with neck hanger.

FIG. 1 depicts a novel face mask with a neck hanger 950. The face mask 950 comprises of a typical face mask 951, an air pipe 953 that receives air from a neck hanger 952 using fan 957 and inject it into the face mask 951, an air pipe 954 that receives contaminated air from interior of the face mask 951 and delivers it to neck hanger 952. Air pipes 953 and 954 are attached to the face mask 951 through connectors 955 and 956. Fresh air is sucked from free space by neck hanger 952 using a sucking fan and delivered to face mask 951 using an air pipe 953 that is connected to both neck hanger 952 and face mask 951. Contaminated air from interior of the face mask 951 is received by air pipe 954 that is connected to both face mask 951 and neck hanger 952 and delivered to neck hanger 952 to be sucked by fan 958 and released into free space. The air pipes 953 and 954 may be part of neck hanger 952 or face mask 951.

In one embodiment, the neck hanger 952 is also used as a neck cooler by blowing some of the air it sucks by fan 957 from free space towards the neck.

In one embodiment, the neck hanger 952 is used as a neck cooler by blowing the filtered contaminated air received from interior of the face mask 951 towards the neck.

In one embodiment, the neck hanger 952 is used as a neck cooler by blowing some of the filtered environment air sucked air by fan 957 and the filtered contaminated air received from the interior of the face mask 951 towards the neck using air apertures or opening holes.

In another embodiment, the air flow of air aperture or opening hole is controlled by changing the opening of the aperture or hole In another embodiment, the neck hanger 952 sucks the air from free space using fan 957 and send it to the face mask 951 without filtering.

In one embodiment, the neck hanger 952 sucks the air from free space using fan 957 and send it to the face mask 951 after being filtered.

In another embodiment, the neck hanger 952 sucks the air from free space using fan 957 and sends some of it after being filtered into the interior of the face mask 951 and blow the remaining of the sucked air filtered or unfiltered towards the neck for cooling.

In one embodiment, the air pipes 953 and 954 are part of the neck hanger 952 and can be slide inside the neck hanger 952 when not connected to the face mask 951.

In one embodiment, the air pipes 953 and 954 are independent components and are connected to both face mask 951 and neck hanger 952 through various simple (connectors) methods that prevent any air leak.

In another embodiment, the amount of air passed through interior of the face mask 951 is controlled by various known practical methods such as speed of fan, the amount of sucked air that is used for cooling, releasing extra air, etc.

In another embodiment, the amount of air used by neck hanger 952 for cooling neck (back of the head) is controlled by various known practical methods such as opening and closing the apertures or holes that blow the air, reducing the opening of the apertures or holes, reducing fan speed, etc.

In one embodiment, the amount of sucked air from free space by fan 957 and contaminated air from interior of the mask by fan 958 is controlled and adjusted through various known practical methods such changing the DC voltage applied to the fans.

In another embodiment, neck hanger 952 uses fan 958 to suck the contaminated air from the interior of the face mask 951 through air pipe 954 as well as some air from free space to use for cooling the neck (or back of the head) through apertures or opening holes on peripheral of the neck hanger 952.

In one embodiment, the neck hanger 952 stores purified oxygen in the neck hanger 952 and through an injection aperture mixes a controlled amount of purified oxygen with filtered or unfiltered air sucked from free space by fan 957 before sending the mixed air through air pipe 953 into the interior of the face mask 951.

In another embodiment, the amount of purified oxygen that mixes with sucked and filtered or unfiltered air from free space is controlled for different applications.

In one embodiment, the novel face mask with a neck hanger 950 is used for various applications when body needs air with required oxygen level. These applications are people with asthma, high elevation hikers, hospital patients, nurses, doctors, miners, gliders, people with breathing problem, people with heart problem, people with medical problems that need higher level of oxygen, skiers at high elevations, ordinary people in areas with high level of air pollution (cities), fire fighters, tourist in high elevation places, factory workers, carpenters, chemical lab workers, airplane passengers, and any other application that requires a face mask.

Figure 2:
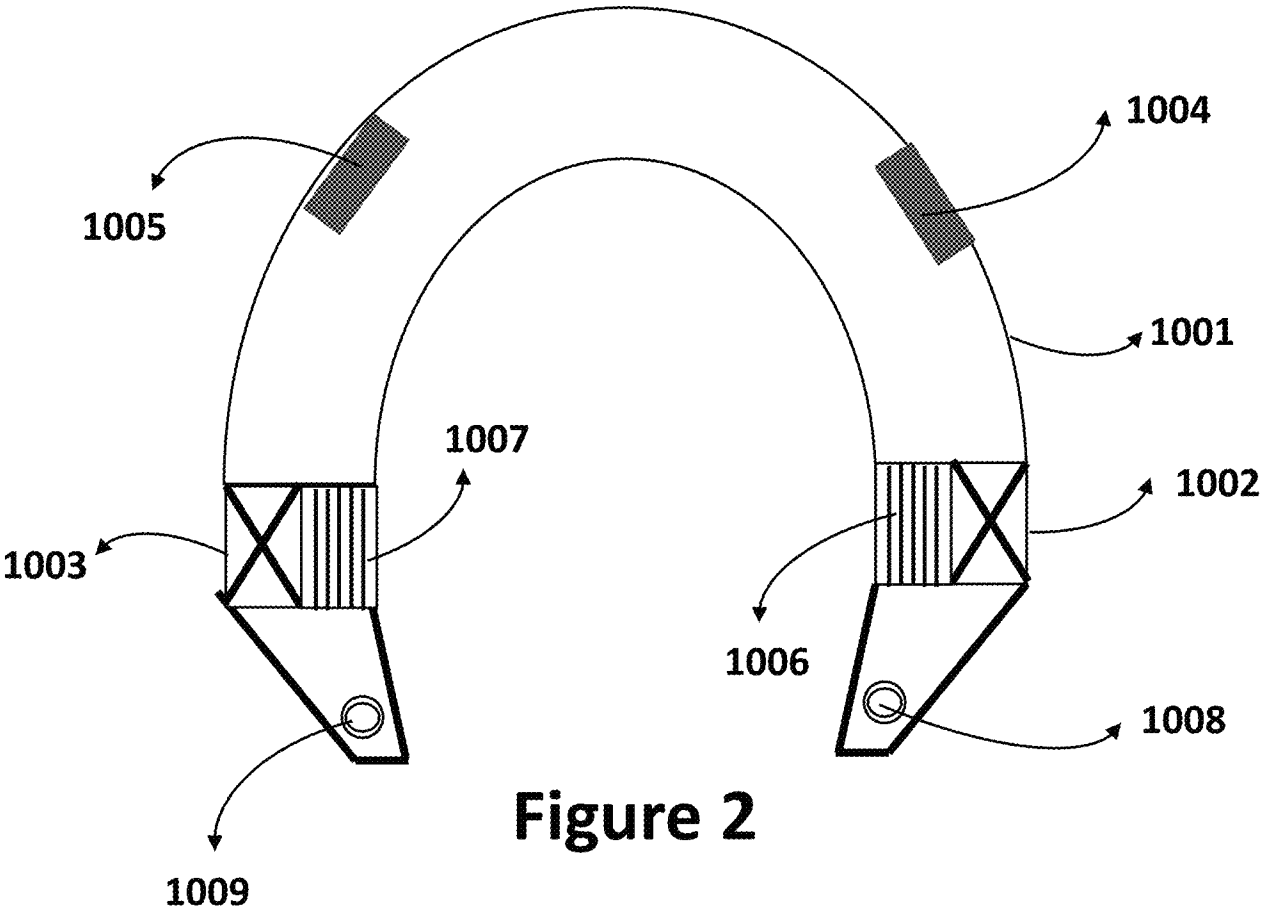
FIG. 2 illustrates a neck hanger that supplies air to the mask.

FIG. 2 depicts a neck hanger 1000. The neck hanger 1000 uses a fan 1002 to suck the air from environment, filter it with filter 1006 and send it from outlet 1008 to the interior of the face mask 951 through air pipe 953. The contaminated air from face mask 951 is sent through air pipe 954 to inlet 1009 of neck hanger 1000, then filtered by filter 1007 and released into the environment by fan 1003.

The neck hanger 1000, among other things includes a flexible tube 1001, sucking fans 1002 and 1003, filters 1006 and 1007, battery housings 1004 and 1005, outlet 1008 and inlet 1009.

The flexible tube 1001 can be solid or hollow depending on application of neck hanger 1000. The flexible tube 1001 is made of very light materials to keep the overall weight of the neck hanger 1000 low. The battery housings 1004 and 1005 (it is possible to use only one housing with one battery to power both fans) accommodates the batteries that power the fans 1002 and 1003. The outlet 1008 and inlet 1009 have circular (square, or other) cross sections and provide necessary requirements to connect to air pipes 953 and 954 without any leakage of air.

The fans 1002 and 1003 both suck air from environment and the interior of the face mask 951 respectively and their sucking power is adjusted independently by controlling the DC voltage apply to them from the batteries housed in1004 and 1005 (the control is done by a controller circuit that resides in one of the battery housing or a single housing that provides power to both fans) assigned to them. The filters 1006 and 1007 both are either high efficiency particulate air (HEPA) filters, ultra-low particulate air (ULPA) filters, or any proprietary filter based on the application of the face mask with a neck hanger 950.

There are several options for filtering the environment air and interior air of the face mask. The filtering function by filter 1006 can be performed first and then suck (by sucking fan 1002) the filtered environment air after being filtered by filter 1006. Another option is to suck the environment air by sucking fan 1002 first and then filter it by filter 1006. A third option is performing the function of filtering by the air pipe 953. In other words, air pipe 953 which is connected to neck hanger 952 (neck hanger 1000 outlet through connector 1008) and face mask 951 functions as a tunned for the air from neck hanger 1000 to the face mask 951 and a filter (HEPA, ULPA, or proprietary). A fourth option is to have filter at two of the above explained locations (before sucking fan, after sucking fan, and air pipe). A fifth option is to have the filter at all three locations explained above (before sucking fan, after sucking fan, and air pipe). The above options also applies to air pipe 954, sucking fan 1003 and filter 1007.

Figure 3A:
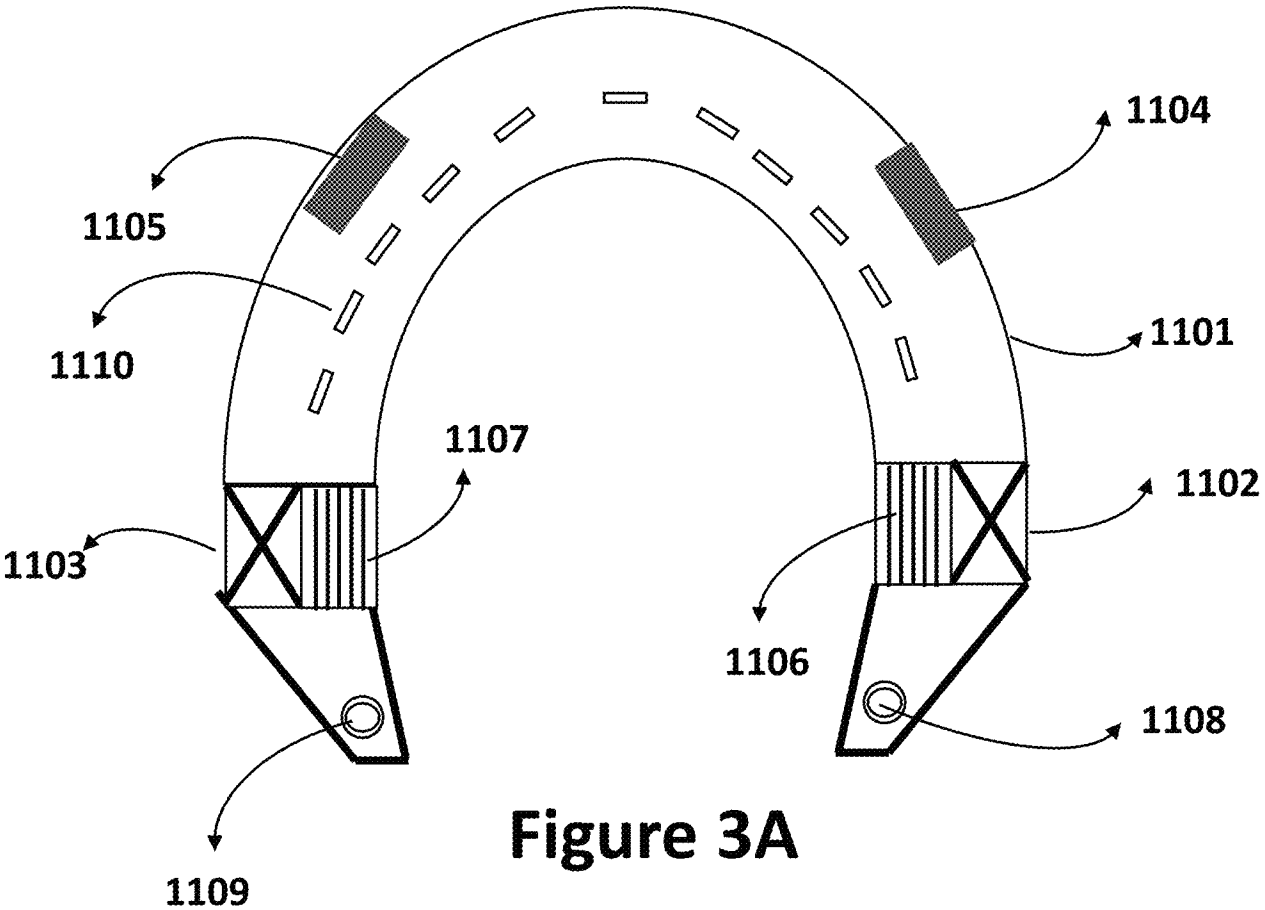
FIG. 3A illustrates a neck hanger that supplies air to the neck and cools the neck.

FIG. 3A shows a neck hanger 1100. Neck hanger 1100 in addition to facilitating flow of fresh and filtered air in interior of the face mask 951 performs cooling of the neck by blowing air towards the neck and head. The air sucked by fan 1102 is filtered by filter 1106 before sending portion of filtered air into the interior of the face mask 951 from outlet 1108 through air pipe 953 and blowing the remaining of the filtered air through apertures or holes 1110 towards the neck and head. The speed of the air flow from the apertures 1110 can be adjusted by reducing the opening of the apertures or by totally closing a selected number of apertures 1110.

Contaminated air from the interior of face mask 951 is sucked by fan 1103 from inlet 1109 through air pipe 954, filtered by filter 1107, then sent to the apertures 1110 for blowing towards the neck. Fan 1103 in addition to the contaminated air it sucks from the interior of the mask through air pipe 954 and inlet 1109 may also suck air from environment through a separate inlet on the neck hanger tube 1101 to increase the amount of air that is blown towards neck and head through apertures 1110.

The neck hanger 1100, among other things includes a flexible tube 1101, sucking fans 1102 and 1103, filters 1106 and 1107, battery and controller housings 1104 and 1105 (it is possible to use one housing with one battery and control circuit for both fans), outlet 1108, aperture 1110, inlet 1109 and possible additional inlet for sucking environment air.

The flexible tube 1101 can be solid or hollow depending on application of neck hanger 1100. The flexible tube 1101 is made of very light materials to keep the overall weight of the neck hanger 1100 low. The tube 1101 has either a U-shape, a horseshoe shape, or a proprietary shape. The battery housings 1104 and 1105 accommodates the batteries (and a controller circuit) that power the fans 1102 and 1103. The outlet 1108 and inlet 1109 have circular (square, or other) cross sections and provide necessary requirements to connect to air pipes 953 and 954 without any leakage of air. Additional inlet also can be provided on the flexible pipe 1101 to be used by fan 1103 to suck extra air from the environment. The tube 1101 can have a key on its external surface for turning on and off the operation of the neck hanger 1100. The neck hanger 1100 can also have a reset bottom on the external surface of the tube 1101 to reset the controller circuit.

The flexible tube 1101 is hollow and made of very light materials (like plastic, fiber glass, aluminum, etc.) to keep the overall weight of the neck hanger 1101 low. The battery housings 1104 and 1105 accommodates the batteries (and a controller circuit) that power the fans 1102 and 1103. The DC voltage from batteries applied to fans are independently adjusted by two (or one controller) controllers that are housed in neck hanger 1100. The outlet 1108 and inlet 1109 have circular cross sections and provide necessary requirements to connect to air pipes 953 and 954 without any leakage of air to the environment.

Figure 3B:
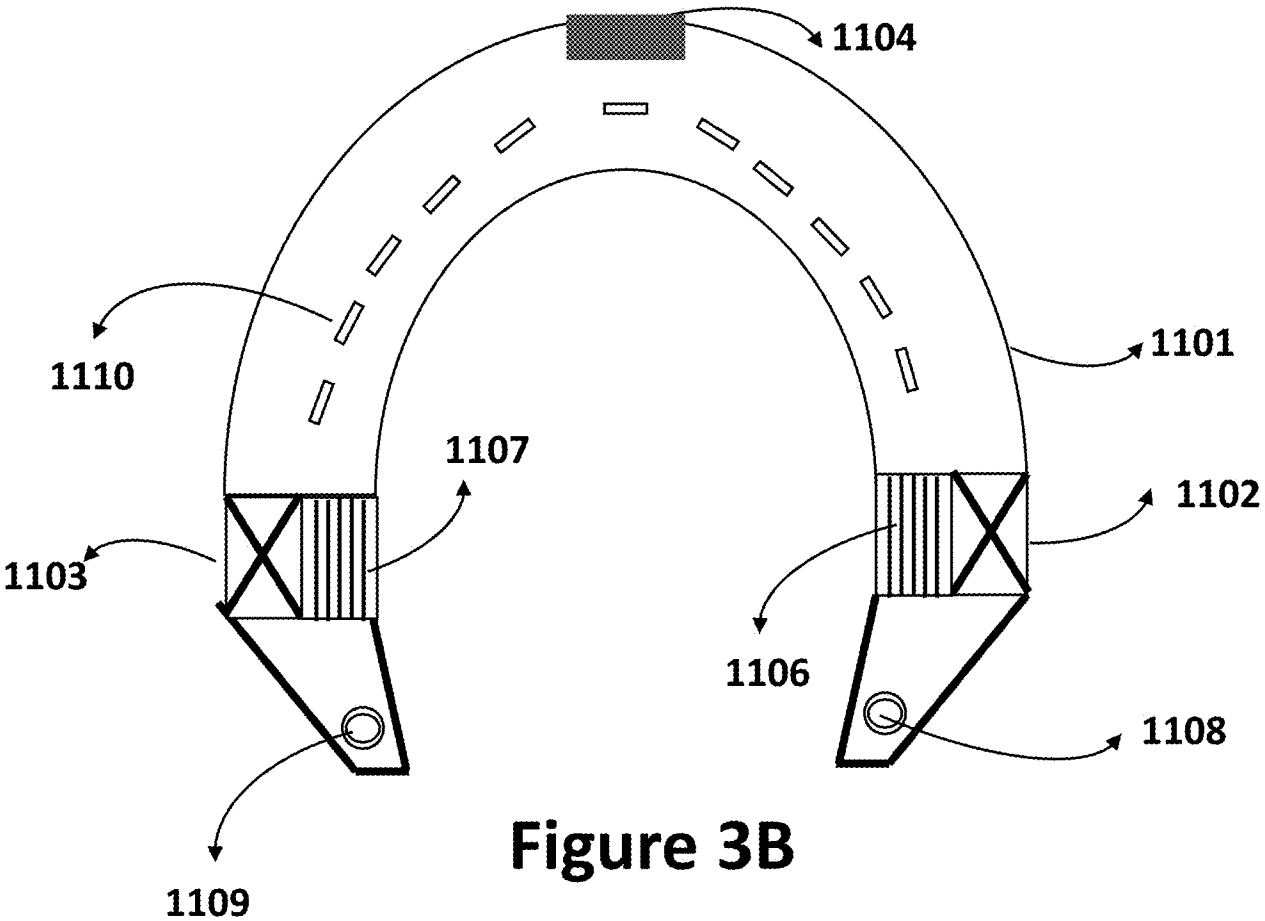
FIG. 3B illustrates a neck hanger that supplies air to the neck and cools the neck with a single housing for battery and controller.
Figure 4A:
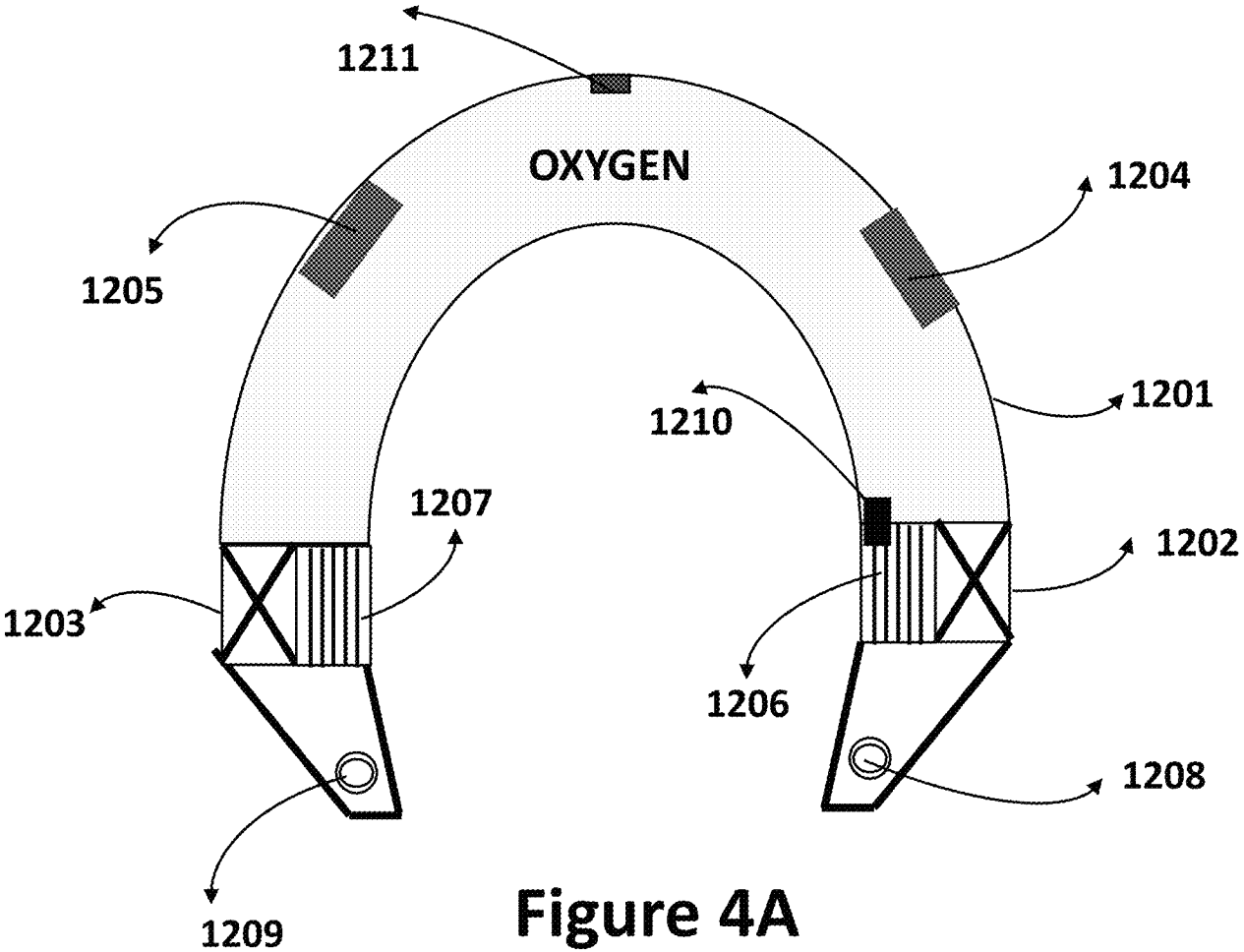
FIG. 4A illustrates a neck hanger that supplies air and purified oxygen to the mask.

FIG. 3B shows the neck hanger 1100 when only one housing 1104 is used for the battery that powers the fans, LED, sensors, controller circuit electronics, and any moving components that requires power. The housing in addition to the battery also houses the controller circuit electronics. The housing has an USB port or other ports for charging the batteries and communication with external device, FIG. 4A illustrates neck hanger 1200. Neck hanger 1200 in addition to functions that neck hanger 1000 performs is also an oxygen tank for purified oxygen. Neck hanger 1200 facilitates flow of fresh and filtered air that is mixed with purified oxygen from the oxygen tank inside the face mask 951. The air sucked by fan 1202 is filtered by filter 1206 and mixed with injected purified oxygen from injector 1210 before sending it into the interior of the face mask 951 from outlet 1208 and through air pipe 953. Contaminated air from interior of the face mask 951 is sucked by fan 1203 through air pipe 954 and inlet 1209 then filtered by filter 1207 and released to the environment.

The neck hanger 1200, among other things includes a flexible or solid oxygen tank 1201, sucking fans 1202 and 1203, filters 1206 and 1207, battery housings 1204 and 1205, outlet 1208, inlet 1209, oxygen injection port 1210 and oxygen refill port 1211.

The solid (flexible) circular (square or other shapes) oxygen tank 1201 houses purified oxygen for mixing with filtered fresh air from environment. The flexible or solid circular (square or others) oxygen tank 1201 is made of very light materials to keep the overall weight of the neck hanger 1200 low. The battery housings 1204 and 1205 accommodates the batteries that power the fans 1202 and 1203. The outlet 1208 and inlet 1209 have circular (square or others) cross sections and provide necessary requirements to connect to air pipes 953 and 954 without any leakage of air. The sucked air from environment by fan 1202 is first filtered by HEPA or ULPA filter 1206 then mixed with the purified oxygen from oxygen tank through injection port 1210 before sending into the interior of the mask 951 through outlet 2108 and air pipe 953. The oxygen tank is refilled through refill port 1211.

The injection port 1210 is controlled to inject oxygen continuously or as needed. When oxygen is injected continuously it can be controlled to inject the amount of oxygen that is needed and the person wearing face mask 951 feels comfortable. The oxygen also can be injected as needed. This is down in two ways. First way is to have a controller that injects the oxygen in a controlled interval by opening the injection port 1210 for a controlled time window and then close the injection port 1210. The interval between two injection time windows is also controlled. Therefore, the injection port 1210 opens for a time window and closes for an interval of time and again opens for a time window. Both open time window and closed interval between two openings of injection port 1210 is controlled by a controller. This way oxygen tank last longer.

The second method is opening the injection port 1210 manually as needed. The person wearing face mask with neck hanger 950 decides when there is a need for extra oxygen and opens the injection port 1210 for a defined time window. The time window can be different each time it is opened manually.

Figure 4B:
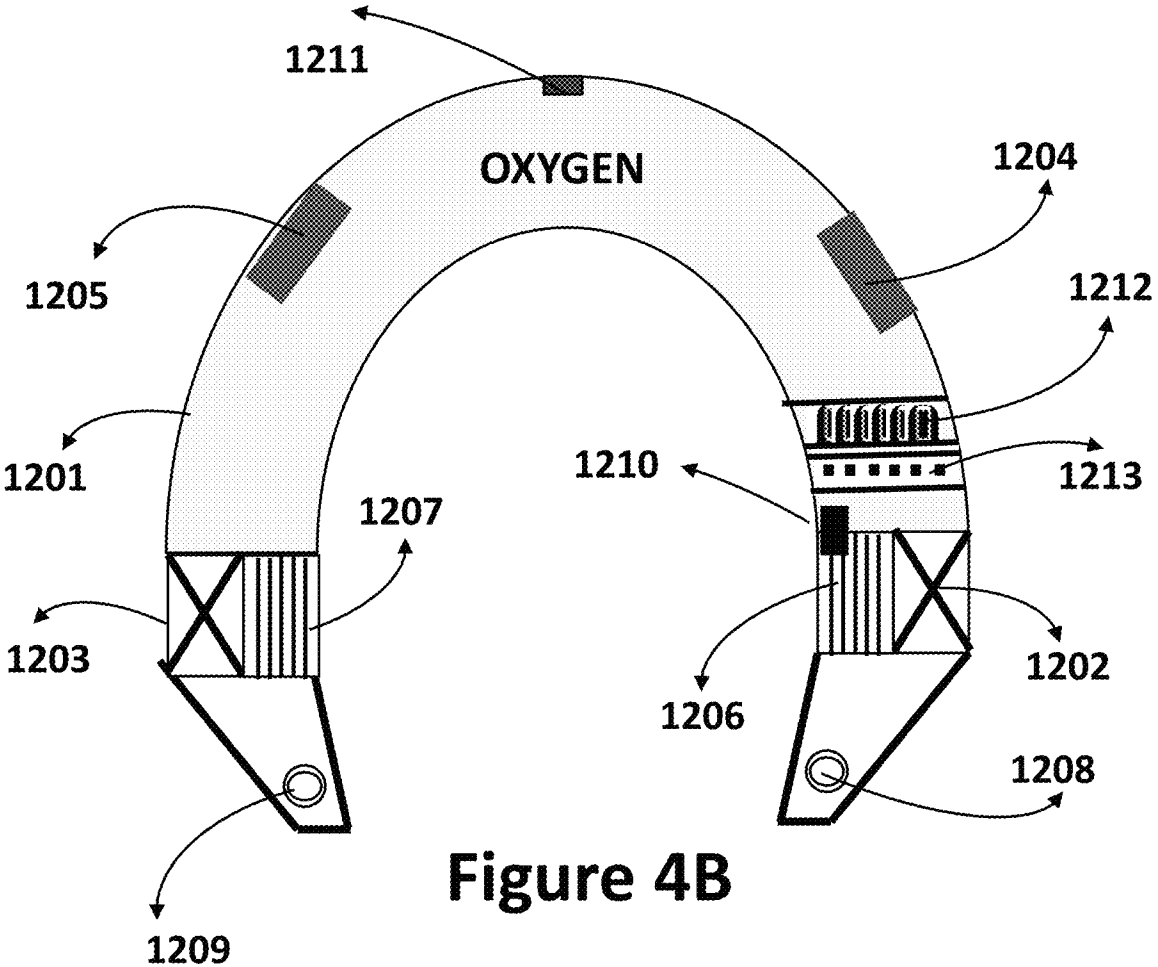
FIG. 4B depicts a neck hanger with a regulator.

FIG. 4B depicts neck hanger 1200 with a regulator. The regulator consists of pressure reducer 1112 and a flow adjuster 1113. These two components 1112 and 1113 are adjusted mechanically by rotating them or by other means. The oxygen tank can be a tank within the neck hanger tube 1201. The entire of neck hanger 1201 or a portion of it can also be used as oxygen tank. It all depends on several parameters which are safety issues, weight, pressure of compressed oxygen (in any form, gas, solid or liquid), and complexity. The regulator should also function as a pressure gauge and a flow meter. One way of providing these two functions is to use sensors one as pressure sensor and another as flow sensor. The other approach is to have provisions for a pressure gauge or flow meter to be connected to the regulator when needed like a valve that is used to refill the oxygen tank.

The sensors measure the pressure and the flow of the oxygen and send the information to a controller circuit that is in the battery or power housing. The neck hanger can have a single housing for a single battery to power both sucking fans 1202 and 1203. The speed of the fans is controlled by the controller by changing the DC (direct current) voltage applied to the sucking fans 1202 and 1203. The power housing for battery and controller can have a USB port or other power ports for charging the battery. The USB port is also used for communication between controller circuit and external devices. The controller circuit can also use a wireless transceiver like Bluetooth, Zigbee, Infrared, or WiFi (wireless fidelity) to communicate with external devices.

The controller circuit within the power housing performs several tasks. One of the tasks is to control the speed of the fans by changing the DC voltage applied to the fans. The controller based on the information it obtains from various sensors (in the air pipes, inside the mask) decides what voltage to applied to the sucking fans 1202 and 1203. The decision is made by an artificial intelligence (AI) algorithm that is executed in the controller's CPU (central processing unit). A second task is to monitor the amount of charge of the batteries through appropriate sensors and use an LED (light emission diode) which is capable of deeming, a red LED when the charge is below a threshold, or communication to an external device like smart phone the amount of available charge. A third task is to monitor the pressure of oxygen tank and estimate the amount oxygen in the tank and indicate when the tank needs to be refilled through a red LED or communicating with an external device. A fourth task is to act as a flow meter for the regulator flow adjuster 1213 using a sensor that measures the oxygen flow. If the oxygen flow is below a threshold, then the controller indicates through an LED light or communicate to an external device. A fifth task is to connect to an external device and configure the mask with neck hanger 950. The configurations parameters are initial operating parameters of the mask with neck hanger 950 that include various thresholds, and settings. Another task of controller is to perform diagnostic and alarms.

Figure 5:
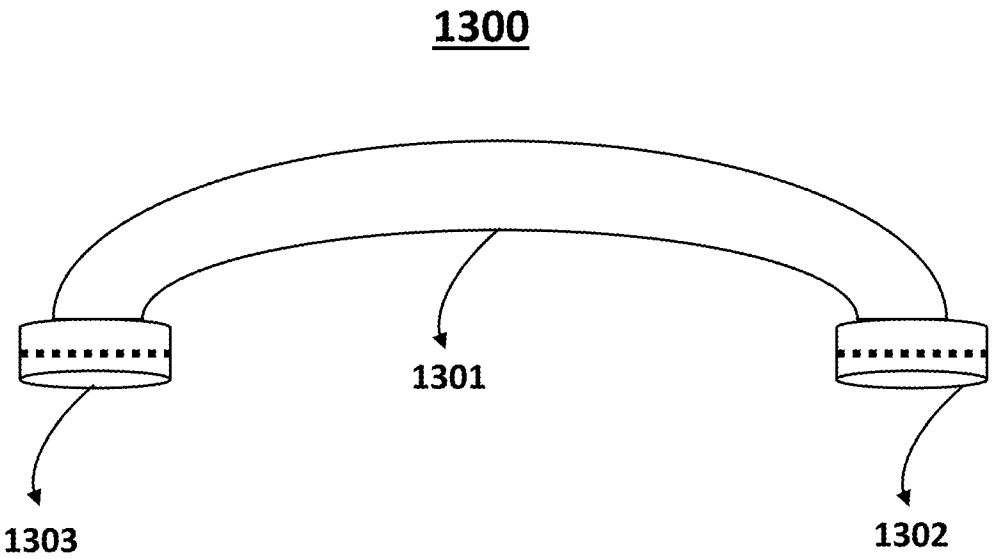
FIG. 5 illustrates the pipe that carries air to the mask and its connection port to neck hanger.
Figure 5:
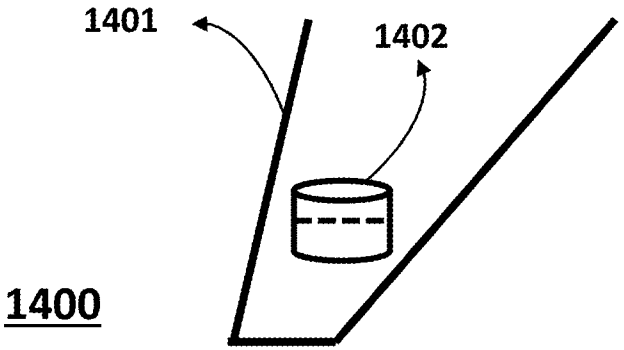

FIG. 5 shows flexible air pipe 1300 and outlet or inlet of neck hanger 1400. Flexible air pipe 1300 comprises of air pipe 1301 and female heads 1302 and 1303. Female heads 1302 and 1303 are used to connect the flexible pipe 1300 to face mask 951 and neck hanger 952. Neck hanger 1401 has the male head 1402 for the female head 1302 of air pipe 1301. There are various methods of connecting the air pipe 1301 to the neck hanger 1401. Flexible pipe fittings are available in a variety of shapes and materials. Some of these methods are:

a) Push fitting
b) Press fitting
c) Telescopic tube fitting
d) Telescopic tube lock
e) Telescoping clamp
f) Telescoping tube pushing
g) Telescopic tube by quick connect
h) Using threaded male and female heads Female head 1303 of the flexible (or solid) pipe 1301 is for connecting to face mask 951. Female head 1303 can be different from female head 1302 due to its connection to the mask. Instead of female head it is possible to use a male head for 1303 and have the female head on the face mask 951. The same can be applied to head 1302, use male head for 1302 and have the female head on the neck hanger 1401.

Figure 6:
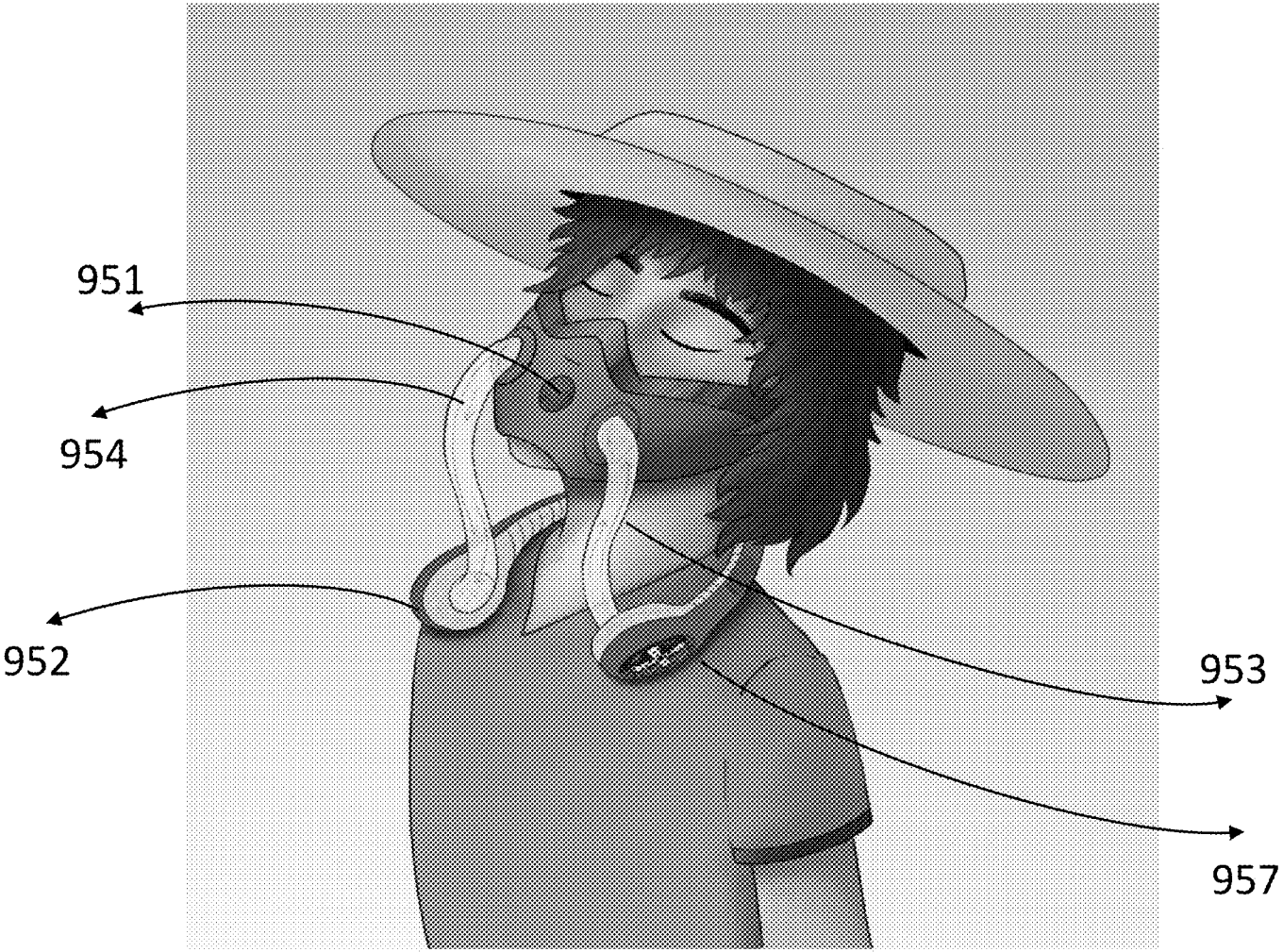
FIG. 6 shows a typical industrial design for the face mask with neck hanger.

FIG. 6 depicts a typical industrial design for novel face mask with a neck hanger 950. This figure shows one implementation and locations of fan that are towards either end on "U" shape or horseshoe (a proprietary) shape neck hanger 952. The neck hanger 952 may be flexible and person who wears it being able to adjust it for comfort. The air pipes 953 and 954 are also flexible to allow easy connection to the mask 951 and neck hanger 952 and provide a comfortable feeling for the person who wears the face mask with a neck hanger 950. The flow of the air is from air pipe 953 to air pipe 954 through the interior of the mask 951. This flow of the air will not be disturbed due to the direction the sucking fans suck the air and blow the air.

Figure 7:
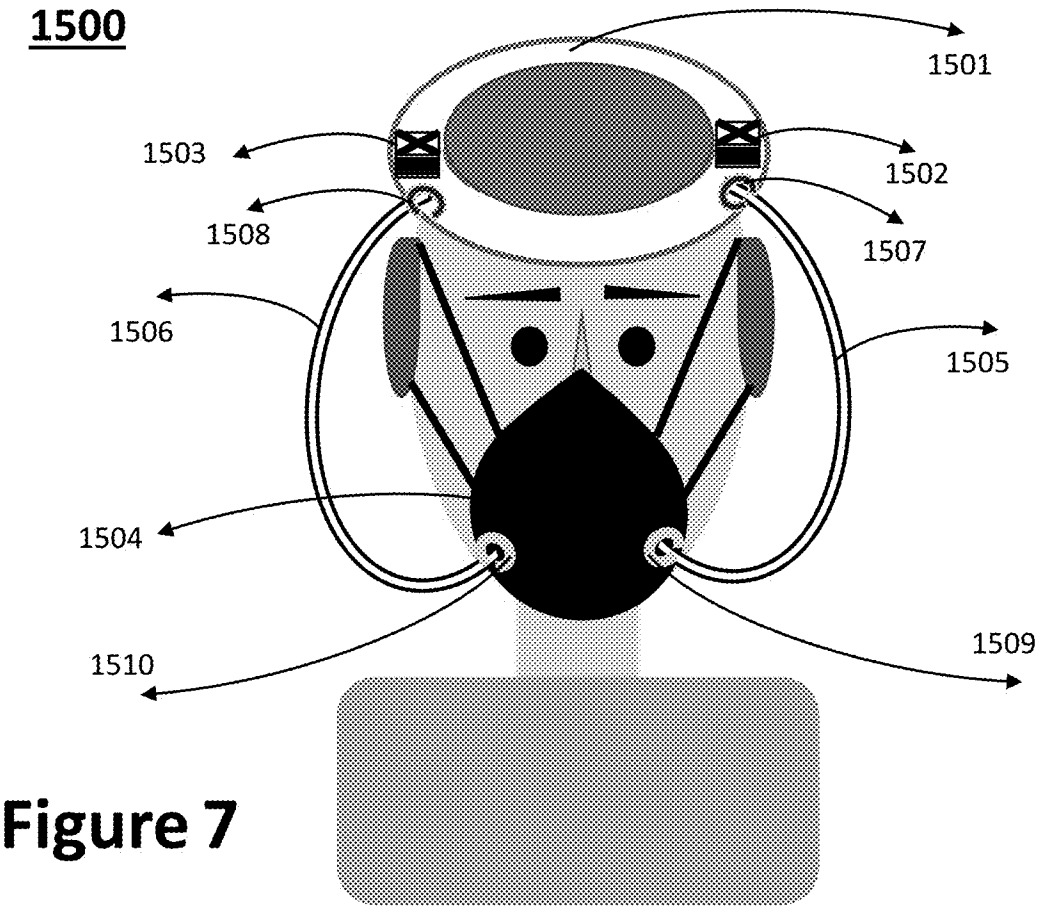
FIG. 7 illustrates a face mask with a head ring.

FIG. 7 depicts a novel face mask with a head ring 1500. The face mask with a head ring 1500 comprises of a typical face mask 1504, an air pipe 1505 that receives air from a head ring 1501 using sucking fan 1502 and inject it into the interior of the face mask 1504, an air pipe 1506 that receives contaminated air from interior of the mask 1504 and delivers it into head ring 1501. Air pipes 1505 and 1506 are attached to the face mask 1504 through connectors 1509 and 1510. Fresh air is sucked from free space by head ring 1501 using sucking fan1502 (which has a HEPA or ULPA filter attached to it) and delivered to the interior of the face mask 1504 using the air pipe 1505 that is connected to both head ring 1501 and face mask 1504. Contaminated air from face mask 1504 is received by air pipe 1506 that is connected to both face mask 1504 and head ring 1501 and delivered into head ring 1501 to be sucked by fan 1503 (which has a HEPA or ULPA filter attached to it) and released to free space. The air pipes 1505 and 1506 may be part of head ring 1501 or face mask 1504.

i) In one embodiment, the head ring 1501 is also used as a neck and/or face cooler by blowing some of the air it sucks by fan 1502 from free space towards the face and neck.

j) In one embodiment, the head ring 1501 is used as a neck and/or face cooler by blowing the filtered contaminated air sucked by fan 1503 from the interior of the face mask 1504 towards the neck and face.

k) In one embodiment, the head ring 1501 is used as a neck and/or face cooler by blowing some of the filtered sucked air by fan 1502 from environment and the filtered contaminated air by fan 1503 from the interior of the face mask 1504 towards the neck and/or face using air apertures or opening holes.

l) In another embodiment, the air aperture or opening hole air flow is controlled by changing the cross-section area of opening of the aperture or hole.

m) In another embodiment, the head ring 1501 sucks the air from free space using fan 1502 and send it into the interior of the face mask 1504 without filtering.

n) In one embodiment, the head ring 1501 sucks the air from free space using fan 1502 and sends it into the interior of the face mask 1504 after being filtered.

o) In another embodiment, the head ring 1501 sucks the air from free space using fan 1502 and sends some of it into the interior of the face mask 1504 after being filtered and blow the remaining of the sucked air from free space filtered or unfiltered towards the neck and/or face for cooling.

p) In one embodiment, the air pipes 1505 and 1506 are part of the head ring 1501 and can be slide inside the head ring 1501 when not connected to the face mask 1504.

q) In one embodiment, the air pipes 1505 and 1506 are independent components and are connected to both face mask 1504 (through connectors 1509 and 1510) and head ring 1501 (through connectors 1507 and 1508) using various simple methods that prevent any air leak.

r) In another embodiment, the amount of air that is passed through face mask 1504 is controlled by various known practical methods such as speed of fan, the amount of sucked air that is used for cooling, releasing extra air, etc.

s) In another embodiment, the amount of air used by head ring 1501 for cooling the neck and/or face is controlled by various known practical methods such as opening and closing the apertures or holes that blow the air, reducing the opening of the apertures or holes, reducing fan speed, etc.

t) In one embodiment, the amount of sucked air from free space by fan 1502 and contaminated air from interior of the mask 1504 by fan 1503 is controlled and adjusted through various known practical methods such as changing the DC voltage applied to the fans.

u) In another embodiment, head ring 1501 uses fan 1503 to suck the contaminated air from interior of the face mask 1504 through air pipe 1506 as well as some air from free space to use for cooling the neck and/or face through apertures or opening holes on the peripheral of the head ring 1501.

v) In one embodiment, the head ring 1501 stores purified oxygen inside the head ring 1501 and through an injection aperture mixes controlled amount of the purified oxygen with filtered or unfiltered air sucked from free space by fan 1502 before sending the mixed air through air pipe 1505 to the face mask 1504.

w) In another embodiment, the amount of purified oxygen that mixes with sucked and filtered or unfiltered air from free space is controlled for different applications.

x) In one embodiment, the novel face mask with head ring 1500 is used for various applications when body needs air with required oxygen level. These applications are people with asthma, high elevation hikers, hospital patients, nurses, doctors, miners, gliders, people with breathing problem, people with heart problem, people with medical problems that need higher level oxygen, skiers at high elevations, ordinary people in areas with high level of air pollution (cities), fire fighters, tourist in high elevation places, factory workers, carpenters, chemical lab workers, airplane passengers, and any other application that requires a face mask.

Figure 8:
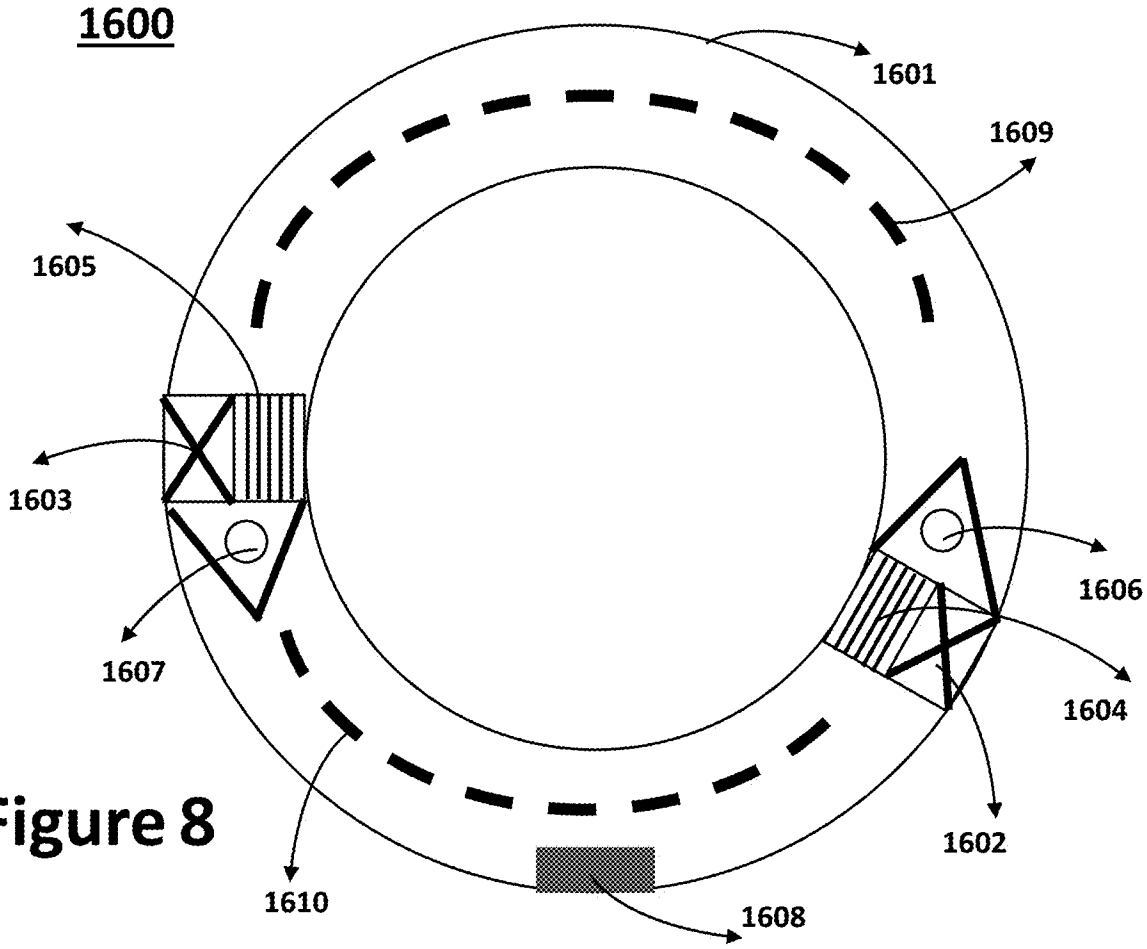
FIG. 8 depicts a head ring that supplies air to the mask.

FIG. 8 shows a detailed head ring 1600 which is used in FIG. 7 as head ring 1501. The head ring 1600 uses a fan 1602 to suck the air from environment, filter it with filter 1604 and send it from outlet 1606 into interior of the face mask 1504 through air pipe 1505. The contaminated air from face mask 1504 is sucked through air pipe 1506 and inlet 1607, filtered by filter 1605 and released to the environment by fan 1603.

The head ring 1600, among other things includes a flexible tube (solid) 1601, sucking fans 1602 and 1603, filters 1604 and 1605, battery and controller housing 1608, outlet 1606 and inlet 1607.

The flexible tube 1601 can be solid or hollow depending on application of head ring 1600. The flexible tube 1601 is made of very light materials to keep the overall weight of the head ring 1600 low. The battery and controller housing 1608 accommodates the battery that powers the fans 1602, 1603, and a controller circuit with a CPU that controls the operation of the face mask with a head ring 1500. The outlet 1606 and inlet 1607 have circular (square, or other) cross sections and provide necessary requirements to connect to air pipes 1505 and 1506 without any leakage of air. The tube 1601 can have a key on its external surface for turning on and off the operation of the head ring 1600. The head ring 1600 can also have a reset bottom on the external surface of the tube 1601 to reset the controller circuit.

The fans 1602 and 1603 suck air from environment and face mask controlling the DC voltage apply to them from the battery and controller circuit in housing 1608. The filters 1604 and 1605 both are either high efficiency particulate air (HEPA) filters, ultra-low particulate air (ULPA) filters, or a proprietary filter based on the application of the face mask with head ring 1500. The same filtering options explained in paragraph 0072 can also be used for the face mask with head ring 1500.

Head ring 1600 in addition to facilitating flow of fresh and filtered air inside the face mask performs cooling of the neck and face by blowing air towards the neck and face. The air sucked by fan 1602 is filtered by filter 1604 before sending portion of filtered air to the interior of the face mask 1504 from outlet 1606 through air pipe 1505 and blowing the remaining of the air through apertures or holes 1609 and 1610 towards the neck and face. The speed of the air flow from the apertures 1609 and 1610 can be adjusted by reducing the opening of the apertures or by totally closing selected number of apertures 1609 and 1610.

Contaminated air from face mask 1504 is sucked by fan 1603 through inlet 1607 and air pipe 1506, filtered by filter 1605, then sent to the aperture 1609 or 1610 for blowing towards the neck and face. Fan 1603 in addition to the contaminated air it sucks from interior of the mask through air pipe 1506 and inlet 1607 it can also suck air from environment through a separate inlet on the head ring tube 1601 to increase the amount of air that is blown towards neck and face through apertures 1609 and 1610.

Head ring 1600 can also be an oxygen tank for purified oxygen. Head ring 1600 facilitates flow of fresh and filtered air that is mixed with purified oxygen from the oxygen tank inside the tube 1601. The air sucked by fan 1602 from the environment is filtered by filter 1604 and mixed with injected purified oxygen before sending into the interior of the face mask 1504 from outlet 1606 and through air pipe 1505 like neck hanger 1200.

The head ring 1600 also like neck hanger 1200 can use a regulator. The regulator consists of pressure reducer and a flow adjuster. These two components are adjusted mechanically by rotating them or other means. The oxygen tank can be a tank within the head ring tube 1601. The entire of head ring tube 1601 or a portion of it can be used as oxygen tank. It all depends on several parameters which are safety issues, weight, pressure of compressed oxygen (in any form, gas, solid or liquid), and complexity. The regulator should also function as a pressure gauge and a flow meter. One way of providing these two functions is to use sensors one as pressure sensor and another as flow sensor. The other approach is to have provisions for a pressure gauge and a flow meter to be connected to the regulator when needed like a valve that is used to refill the oxygen tank.

The sensors measure the pressure and the flow of the oxygen and send the information to the controller that is in the battery and controller housing. The speed of the fans is controlled by the controller by changing the DC (direct current) voltage applied to the sucking fans 1602 and 1603. The power and controller housing for battery and controller circuit can have a USB port or other power ports for charging the battery. The USB port is also used for communication between controller circuit and external devices. The controller circuit can also use a wireless transceiver like Bluetooth, Zigbee, Infrared, or WiFi (wireless fidelity) to communicate with external devices.

The controller circuit within the power and controller housing performs several tasks. One of the tasks is to control the speed of the fans by changing the DC voltage applied to the fans. The controller based on the information it obtains from various sensors decides what voltage to applied to the sucking fans 1602 and 1603. The decision is made by an artificial intelligence (AI) algorithm that is executed in the controller's CPU (central processing unit). A second task is to monitor the amount of charge of the batteries through appropriate sensors and use an LED (light emission diode) which is capable of deeming, a red LED when the charge is below a threshold or communicating to an external device like smart phone the amount of available charge. A third task is to monitor the pressure of oxygen tank and estimate the amount of oxygen in the tank and to indicate when the tank needs to be refilled through a red LED or communicating with an external device. A fourth task is to act as a flow meter for the regulator flow adjuster 1213 using a sensor that measures the oxygen flow. If the oxygen flow is below a threshold, controller indicates through an LED or communicates to an external device. A fifth task is to connect to an external device and configure the mask with head ring 1600. The configurations parameters are initial operating parameters of the face mask with head ring 1500 that include various thresholds, and settings. Another task of controller is to perform diagnostic and alarms.

Figure 9A:
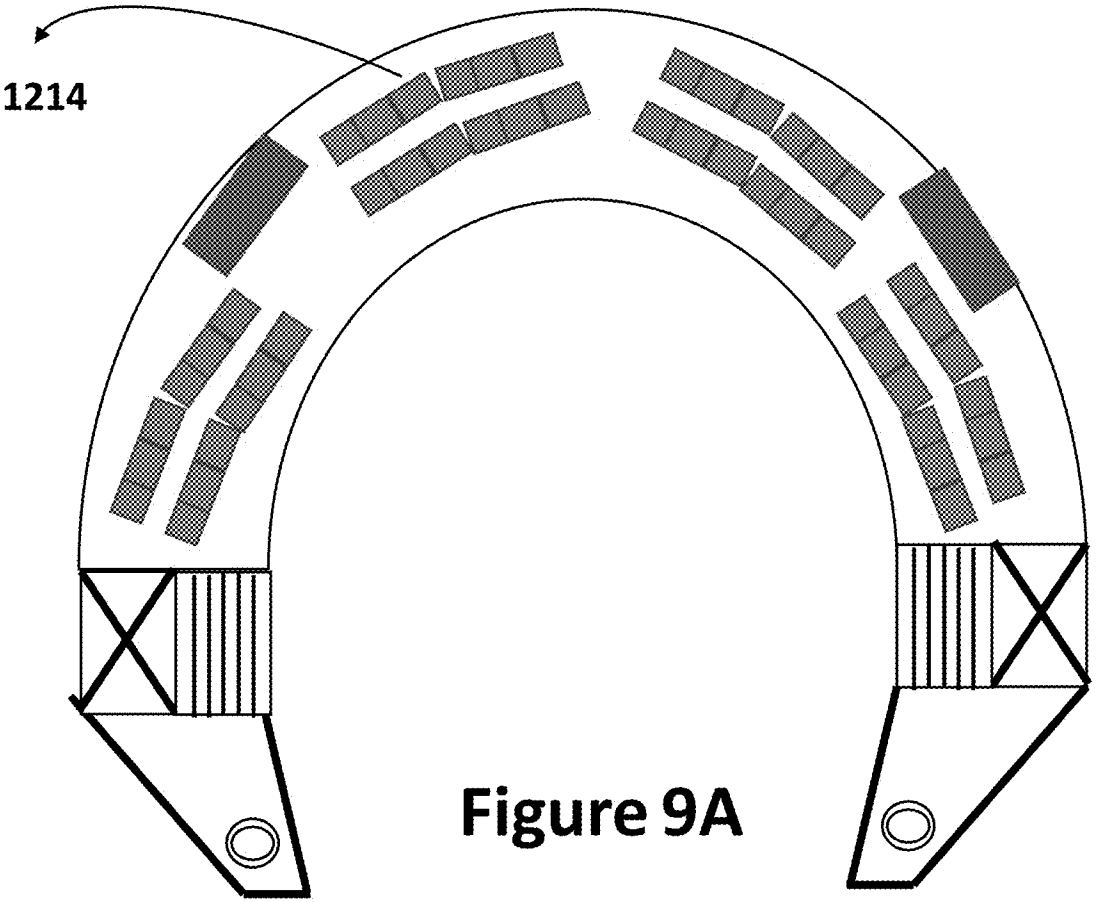
FIG. 9A shows locations on a neck hanger with solar panel.
Figure 9B:
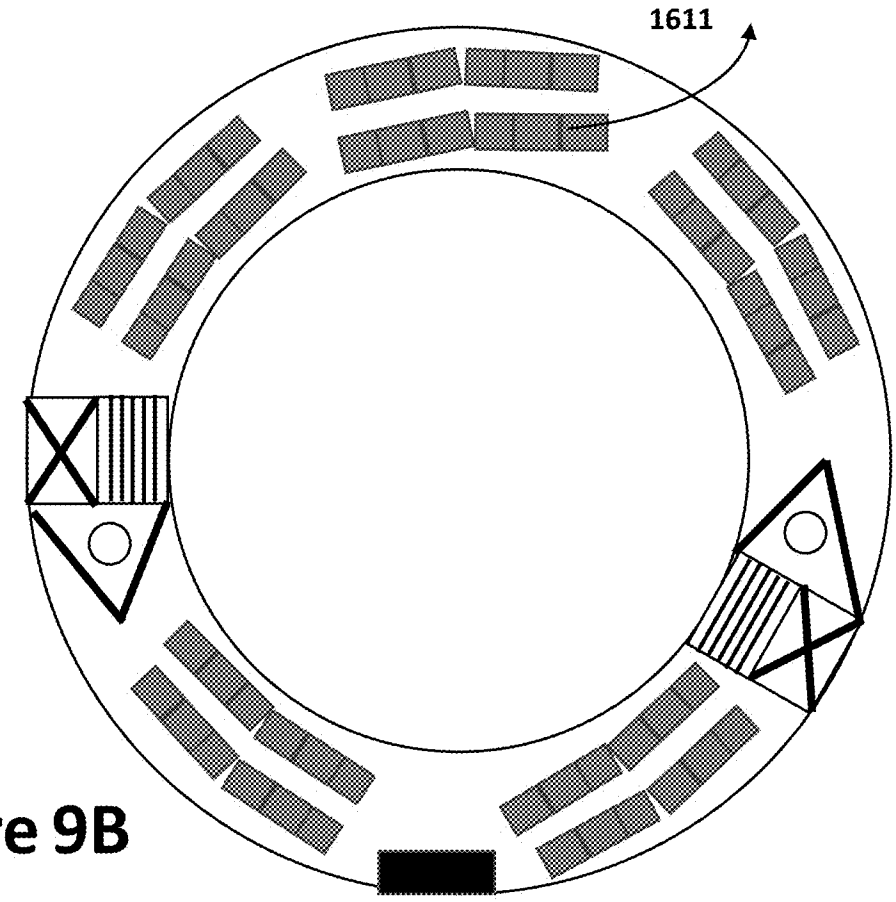
FIG. 9B shows a head ring with solar panel.
Figure 9C:
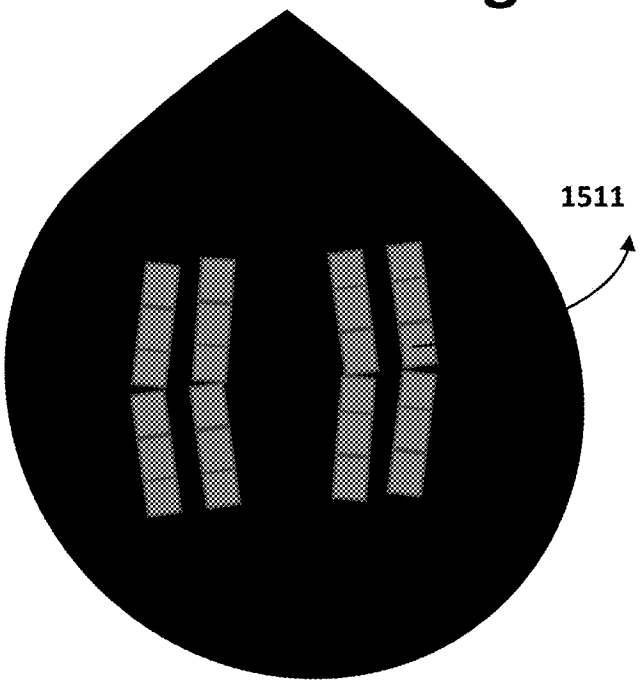
FIG. 9C depicts a face mask with solar panel.

As mentioned before the rechargeable battery can be fully or partially charged through solar cells. The solar cells 1511 may be attached to the external of the face mask as shown in FIG. 9C. The solar cells 1214 and 1611 are attached to the external peripheral of neck hanger 1200 and head ring 1600 as shown in FIGS. 9A and 9B. For both neck hanger 1200 and head ring 1600 in the power and controller housing there is a DC (Direct Current) converter circuit to convert solar energy to the DC voltage required for charging the battery.

Sensors are located at various location of the face mask with a neck hanger 950 and the face mask with head ring 1500 to provide operation information data, measurement information data, and metering information data for the controller located in the battery and controller circuit housing. Controller circuit has a CPU (central processing unit) that receives all information data and use its artificial intelligence algorithm to monitor operation of the face mask with a neck hanger 950 or the face mask with a head ring 1500 in real time and control or modify operation of various components and alert the person wearing them if a deficiency, a problem of a mal function detected. Controller can use LED to show proper function, or mal function of various components. Controller can also use a wireless transceiver or a USB port to send status and real time value of certain parameters to an external device like a computer, a tablet, a smart phone to display numerically or graphically.

The sensors are attached at various locations of the mask with a neck hanger 950 and the mask with a head ring 1500. These location are inside of the mask for air flow, outside of the mask for solar panel, inside of both air pipes, before air filters that are attached to both sucking fans, after the air filters to make sure filters function correctly and are not blocked, various location inside and outside peripheral of the neck hanger tube 1200 (1100) and head ring 1600 for air flow and solar panels, inside of the oxygen tank within neck hanger 1200 (1100) or head ring 1600 for pressure measurement, oxygen tank regulator (after pressure reducer and after flow adjuster), and inside of power and controller housing for monitoring battery power (charge, and other parameters).

It is also possible to have sensors at other locations for other purposes like measuring the altitude (elevation) of the area a mask with oxygen capability is used from sea level. Elevation helps to measure the atmospheric pressure which results in calculating the oxygen level in the atmosphere air. The information data that sensors measure or collect are send to the controller CPU to be used by AI algorithm for analysis.

The face mask with a neck hanger (FMNH) 950 and the face mask with head ring (FMHR) 1500 act like an Internet of Thing (IoT) device. It can communicate with external devices and networks. Since both FMNH 950 and FMHR 1500 have operating fan to make the battery last longer it is always possible to use an external auxiliary battery attached to waist or arm to support required power for both fans and controller circuit wireless transceiver that provides the function of IoT device and communicate real time or as needed with external devices or networks. The auxiliary battery is connected to the FMNH 950 and FMHR 1500 with a power cord through a USB power port or any other power port.

FMNH 950 and FMHR 1500 as IoT devices communicate with other IoT devices like smart phone, computers, and tablets through IoT networks that are fifth generation (5G) wireless network, sixth generation (6G) wireless network, beyond 5G/6G wireless network or Wireless Fidelity (WiFi) network.

FMNH 950 and FMHR 1500 as IoT devices through external devices (using Bluetooth, Zigbee, WiFi and infrared) as well as external devices that are attached to IoT networks can be configured, diagnosed, monitored, and updated with new software for the controller CPU. The analysis data from AI algorithm can be shared with external devices (through Bluetooth, Zigbee, WiFi and infrared) or devices that are attached to IoT network for monitoring as well as modifying the configuration parameters. The controller CPU can also send the raw data collected by various sensors to an external device the way that was explained above for analysis and decision making. The external device based on analysis of raw data decides whether there is a need for the modification of the operating parameters of the FMNH 950 or FMHR 1500 and through IoT network or using Bluetooth, Zigbee, Infrared, or WiFi performs the changing of the operation parameters.

In both cases of FMNH 950 and FMHR 1500 the face masks 951 and 1504 are attached to the face of the person wearing the FMNH and FMHR and cover the nose and the mouth of the person. The face masks 951 and 1504 are not attached to the nose and mouth of the person and there is a gap between the nose and mouth with the interior surface of the mask to allow for air flow within the interior of the mask. However, the peripheral of the face masks 951 and 1504 are attached to the face to prevent any air from environment to enter the interior of the mask and any interior air of the mask to leave the mask through peripheral of the face mask.

The face masks 951 and 1504 use ear loops to attached to the face of a person. For even better attachment it is possible to loop the left ear loop and the right ear loop and connect them together with a paperclip at the back of the head. Another technique for attaching the face mask to the face of the person is to attach the left ear loop to a strap and the right ear loop to another strap and fasten the two straps at the back of the head using hook and loop fastener made up of two pieces of materials: one with lots of tiny loops and another with lots of tiny hooks. Therefore, one of the straps acts as hook and the other strap acts as loop.

Various embodiments are thus described. While embodiments have been described, it should be appreciated that the embodiments should not be construed as limited by such description, but rather construed according to the following claims.

The invention claimed is:

1. An aerosol protection mask (APM) to block unwanted aerosols from an environment comprising:

a neck hanger;

a face mask; and an air pipe;

said neck hanger that is configured to be worn by a wearer using said APM comprising:

a tube that is at least one of a hollow tube and a solid tube, and has at least one of a horseshoe shape and a U-shape, the tube comprising:

a first housing for a first sucking fan with a first filter, a second housing for a second sucking fan with a second filter, a third housing for a battery and a control circuit, an air outlet, an air inlet, and a plurality of opening holes on a peripheral of the tube;

said first sucking fan sucks an air from said environment, filters it by said first filter, then releases a first portion of the air that is filtered into an interior of said face mask through the air outlet and the air pipe, and releases a second portion of the air that is filtered into the tube to be blown out towards the neck of the wearer through the plurality of opening holes;

the second sucking fan sucks an interior air of said face mask through said air inlet and the air pipe, filters the interior air by the second filter and releases it into said tube to be blown out towards the neck of the wearer through said plurality of opening holes;

said face mask comprising:

a mask that is configured to be worn by the wearer using said APM and has a distance from the wearer for air flow;

a mask air inlet for receiving clean air from said neck hanger; and a mask air outlet for releasing contaminated air to the neck hanger;

said air pipe comprising:

a first hollow and flexible air pipe connected to the mask air inlet and the air outlet of the neck hanger; and a second hollow and flexible air pipe connected to the mask air outlet and the air inlet of the neck hanger.

2. The aerosol protection mask (APM) of claim 1, wherein said face mask is configured to be fastened to the wearer by a first ear loop and a second ear loop.

3. The aerosol protection mask (APM) of claim 2, further said face mask is configured to be attached to the wearer by looping the first ear loop and the second ear loop and connecting them together with a paperclip at a back of the wearer.

4. The aerosol protection mask (APM) of claim 3, wherein the first ear loop is attached to a first strap and the second ear loop is attached to a second strap that are configured to fasten at the back of the wearer using hook and loop fastener made up of two pieces of materials: one with lots of tiny loops and another with lots of tiny hooks.

5. The aerosol protection mask (APM) of claim 1, wherein said first filter and said second filter are at least one of a HEPA (high efficiency particulate air) filter, and a ULPA (ultra-low particulate air) filter.

6. The aerosol protection mask (APM) of claim 1, wherein said battery is rechargeable and is charged through an USB (universal serial bus) port.

7. The aerosol protection mask (APM) of claim 1, wherein said plurality of opening holes on the peripheral of said tube can be closed when not needed.

8. The aerosol protection mask (APM) of claim 1, wherein the amount of air flow from an opening hole within the plurality of opening holes on the peripheral of said tube is based on a dimension of said opening hole.

9. The aerosol protection mask (APM) of claim 8, wherein each of said opening hole within said plurality of opening holes, depending on its location on the peripheral of said tube, has different dimensions to provide a uniform air flow across the neck hanger.

* * * * *